US010440984B1

(12) United States Patent
Richmond et al.

(10) Patent No.: US 10,440,984 B1
(45) Date of Patent: Oct. 15, 2019

(54) APPARATUS AND METHOD FOR FILLING PRE-ROLLED WRAPPING PAPERS

(71) Applicant: Banana Bros, LLC, Culver City, CA (US)

(72) Inventors: David Richmond, Culver City, CA (US); Howard Richmond, Los Angeles, CA (US); Manuel A. Montano, Gardena, CA (US); Jeffery Kunkler, Culver City, CA (US)

(73) Assignee: Banana Bros, LLC, Culver City, CA (US)

( * ) Notice: Subject to any disclaimer, the term of this patent is extended or adjusted under 35 U.S.C. 154(b) by 0 days.

(21) Appl. No.: 16/020,438

(22) Filed: Jun. 27, 2018

(51) Int. Cl.

| | |
|---|---|
| ***A24C 5/02*** | (2006.01) |
| ***A24C 5/39*** | (2006.01) |
| ***A24B 13/00*** | (2006.01) |
| ***A24C 5/42*** | (2006.01) |

(52) U.S. Cl.
CPC ..... *A24C 5/392* (2013.01); *A24B 13/00* (2013.01); *A24C 5/02* (2013.01); *A24C 5/42* (2013.01)

(58) Field of Classification Search
USPC ..... 131/287
See application file for complete search history.

(56) References Cited

U.S. PATENT DOCUMENTS 4,422,810 A * 12/1983 Boring ..... B65G 53/528 406/156
2015/0232288 A1* 8/2015 De Jager ..... A24C 5/392 406/12

FOREIGN PATENT DOCUMENTS

WO WO-2014206710 A1 * 12/2014 ..... A24C 5/40

* cited by examiner

*Primary Examiner* — Michael J Felton
*Assistant Examiner* — Katherine A Will
(74) *Attorney, Agent, or Firm* — Smyrski Law Group, A.P.C.

(57) ABSTRACT

A system and method for manufacturing a plurality of uniform cigarettes that uses air current and a vacuum to move and pack plant matter into pre-rolled cigarette papers is provided. Such an apparatus includes an air current generator with an air outlet portion and an air intake portion, a channel configured to channel air current from the air outlet portion of the air current generator, means for holding at least one pre-rolled paper in the channel so that air current generated by the air current generator passes through all pre-rolled papers, and an opening configured to receive organic leafy material and introduce the organic leafy material received into the channel. Airflow from the air current generator provides organic leafy material to the opening, the channel, and the at least one pre-rolled paper in the channel.

18 Claims, 5 Drawing Sheets

APPARATUS AND METHOD FOR FILLING PRE-ROLLED WRAPPING PAPERS

BACKGROUND

I. Field

The present invention generally relates to the manufacture of smoking products, and more particularly, to systems and methods for efficiently filling papers with ground plant matter.

II. Background

Many of the chemical compounds synthesized by plants have been found to have favorable, enjoyable, or beneficial effects when consumed by humans. These effects can be either short-term or long-term, and they may impact a human's health, mental state, and/or other attributes. As a result, humans have taken to the consumption of plant-synthesized chemical compounds (also known as "phytochemicals") for both medicinal and recreational purposes.

As a means for consuming phytochemicals, humans have adopted the practice of smoking, where plant matter containing phytochemicals, such as tobacco or *Cannabis*, is burned to produce inhalable smoke. Humans have created several devices to facilitate smoking, such as pipes or hookahs, but many prefer the convenience and experience of smoking a cigarette, which is produced by wrapping plant matter in a thin piece of paper rolled into a tube.

Pre-manufactured tobacco cigarettes are readily accessible to consumers in packs or cartons sold at stores around the world, however, many individuals prefer to roll their tobacco cigarettes for a number of reasons. Some prefer to roll their cigarettes because it is less expensive to purchase loose tobacco and wrapping paper than to purchase pre-manufactured cigarettes. Additionally, pre-manufactured cigarettes often contain controversial additives and chemicals to help them burn more evenly, so some individuals prefer to roll their own cigarettes to ensure that their cigarettes are free of unwanted additives and chemicals. Additives and chemicals are much less common in pre-manufactured *Cannabis* cigarettes. However, some individuals prefer to roll their own cigarettes, such as *Cannabis* cigarettes, to have greater control over the strain of *Cannabis* used to make the cigarette. Hand rolled *Cannabis* cigarettes are frequently less expensive than their pre-manufactured counterparts.

An individual may create a hand-rolled cigarette by first placing loose plant matter, such as tobacco or *Cannabis*, stock onto a sheet of rolling paper and then using his or her fingertips to wrap and seal the paper around the plant matter. An optional filter or crutch may then be placed on either end of the cigarette to enhance the smoking experience. Unfortunately, a hand-rolled cigarette's quality depends greatly on the preparer's skill and experience, and producing a cigarette with uniform plant matter density can be challenging. Uneven packing can result in an unevenly burning cigarette with a harsher and less enjoyable smoking experience.

Individuals can purchase wrapping papers that have been rolled into a conical or cylindrical shape that may include a crutch or a filter (known in certain instances as a "pre-roll paper" or "pre-rolled paper," used interchangeably herein). Each pre-roll paper has one open end in which an individual may fill the pre-roll paper with plant matter to produce a cigarette. pre-roll papers, as well as machines used to roll cigarettes, offer convenient alternatives to hand-rolling a single cigarette, but both alternatives are inefficient for large-scale cigarette production. Both alternatives often fail to yield consistency among the cigarettes they produce, with the risk of an uneven burn.

*Cannabis* legalization is becoming more common around the world and in many places in the United States. Legal statutes now permit both recreational uses of *Cannabis*, and the demand for *Cannabis*-filled cigarettes continues to increase as the legal market size continues to grow. To meet the demand for *Cannabis*-filled cigarettes, *Cannabis* cultivators have begun filling pre-roll papers with *Cannabis* to produce *Cannabis* cigarettes referred to as "Pre-Rolls" that consumers may then purchase to avoid the need to produce their own *Cannabis* cigarettes. Large-scale production of Pre-Rolls is achieved with devices that use vibrations and gravity to shake ground *Cannabis* into the open ends of a plurality of pre-rolled papers. This method allows for *Cannabis* cultivators to fill many pre-rolled papers with *Cannabis* with greater speed than alternative methods. However, this vibration or shaking method does not ensure a consistent amount of *Cannabis* in each pre-rolled paper. Additionally, after ground *Cannabis* is placed into each pre-roll paper, the *Cannabis* must then be packed more tightly in each pre-roll paper, either by hand or a secondary machine or apparatus, to produce a high-quality Pre-Roll. This takes time and resources.

It would therefore be beneficial to provide a system and method for creating pre-rolls that fills and packs pre-rolled papers with plant matter more efficiently and with more consistent results.

SUMMARY

Thus according to one embodiment, there is provided an apparatus comprising an air current generator with an air outlet portion and an air intake portion, a channel configured to channel air current from the air outlet portion of the air current generator, means for holding at least one pre-rolled paper in the channel so that air current generated by the air current generator passes through all pre-rolled papers, and an opening configured to receive organic leafy material and introduce the organic leafy material received into the channel. Airflow from the air current generator provides organic leafy material to the opening, the channel, and the at least one pre-rolled paper in the channel.

According to a further embodiment, there is provided a method filling pre-roll papers comprising placing at least one pre-rolled paper in an airflow apparatus and inserting organic leafy material into the airflow apparatus while airflow is generated within the apparatus. Inserting organic leafy material into the airflow apparatus causes the organic leafy material to pack into the at least one pre-rolled paper.

According to another embodiment, there is provided an apparatus, comprising an air current generator, a channel configured to channel air current from the air current generator, at least one pre-rolled paper positioned in the channel so that air current generated by the air current generator passes through each pre-rolled paper, and an opening configured to receive organic leafy material and introduce the organic leafy material received into the channel. Airflow from the air current generator provides organic leafy material to the opening, the channel, and the at least one pre-rolled paper in the channel.

To the accomplishment of the preceding and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

Figure 1:
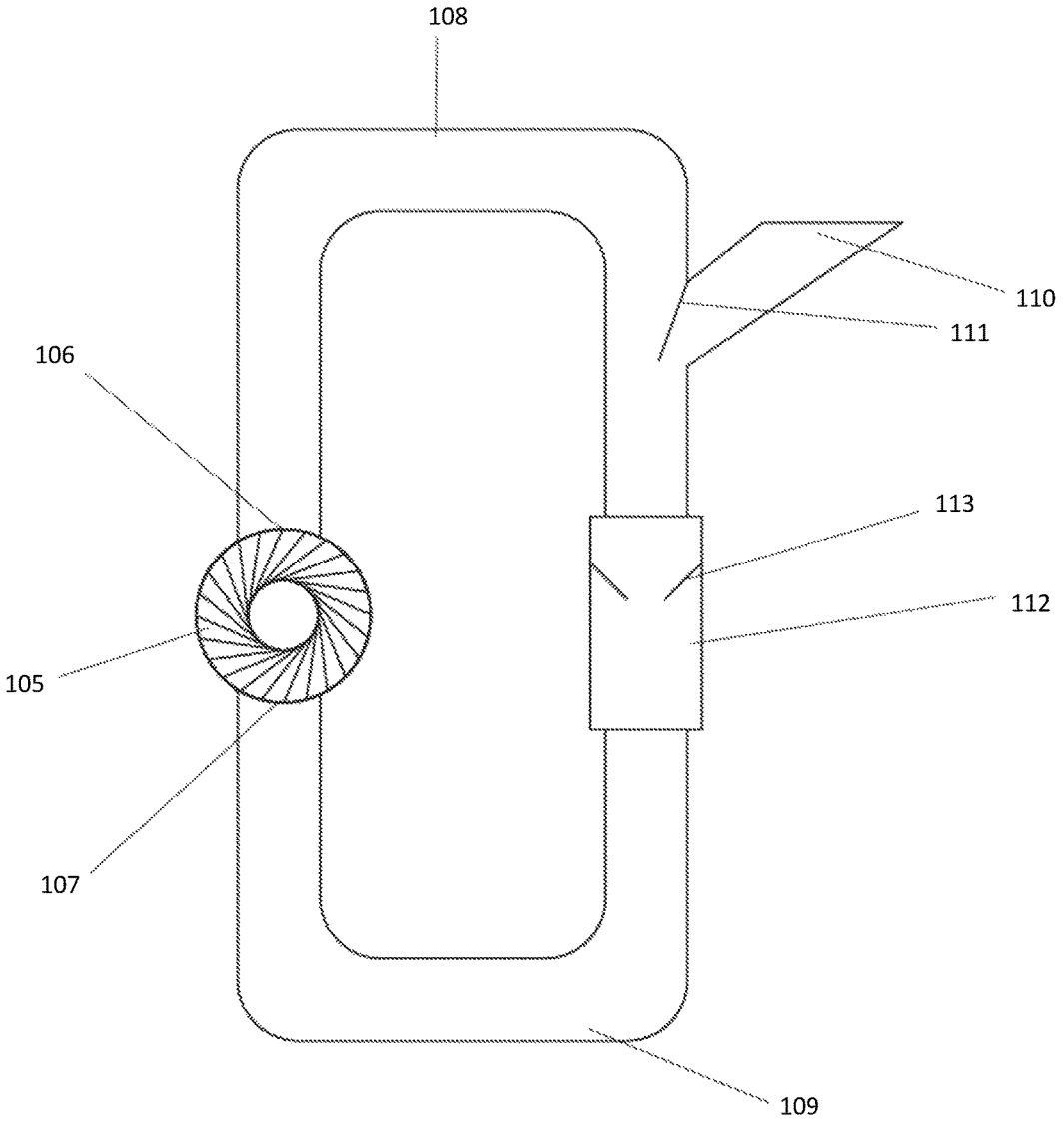
FIG. 1 illustrates an embodiment wherein there is no air current within the apparatus, and neither a pre-roll paper nor plant matter has been added to the apparatus.

In this document, the words "embodiment," "variant," and similar expressions are used to refer to particular apparatus, process, or article of manufacture, and not necessarily to the same apparatus, process, or article of manufacture. Thus, "one embodiment" (or a similar expression) used in one place or context can refer to a particular apparatus, process, or article of manufacture; the same or a similar expression in a different place can refer to a different apparatus, process, or article of manufacture. The expression "alternative embodiment" and similar phrases are used to indicate one of a number of different possible embodiments. The number of possible embodiments is not necessarily limited to two or any other quantity.

The word "exemplary" is used herein to mean "serving as an example, instance, or illustration." Any embodiment or variant described herein as "exemplary" is not necessarily to be construed as preferred or advantageous over other embodiments or variants. All of the embodiments and variants described in this description are exemplary embodiments and variants provided to enable persons skilled in the art to make or use the invention, and not to limit the scope of legal protection afforded the invention, which is defined by the claims and their equivalents.

The present design comprises a means for generating air current (called an "air current generator" herein), a means for retaining the air current generated by the air current generator within the apparatus so that the air current produced by the air current generator returns to the air current generator's air intake (such as by channeling the air current from the air output of the air current generator to the air intake of the air current generator), and a device holding pre-roll (or pre-rolled) papers within the system so that air passes through one end of the pre-roll papers and out of the other. In one embodiment, a circular air current generator design is presented, while in a second embodiment a linear air current generator arrangement is disclosed.

The apparatus is designed to circulate air current through, in one aspect, a closed loop so that the air current within the closed loop moves plant matter, and/or organic leafy material, such as tobacco or *Cannabis*, into at least one pre-roll paper. A resulting vacuum within the apparatus further condenses the plant matter so that the pre-roll paper and condensed plant matter result in consistently filled and packed cigarettes. The apparatus is comprised of a means for creating air current (an "air current generator"), a means for retaining the air current generated by the air current generator within the apparatus so that the air current produced by the air current generator returns to the air current generator's air intake (such as by channeling the air current from the air output of the air current generator to the air intake of the air current generator), and a means for holding pre-roll papers within the system so that air passes through one end of the pre-roll papers and out of the other.

A single pre-roll paper or a plurality of pre-roll papers may be positioned within the apparatus so that when the air current generator produces air current, the air current enters into the distal end of a positioned pre-roll papers (where a smoker will ultimately ignite the cigarette), passes through the length of the positioned pre-roll papers, and exits from the proximal end of the pre-roll papers (where a smoker would ultimately place his or her mouth to inhale through the cigarette). Pre-roll papers are positioned this way to enable the air current to carry plant matter within the apparatus into the distal end of a positioned pre-roll paper. Plant matter may then be captured in the positioned pre-roll paper, and air flowing through a pre-roll paper packs plant matter tightly. Additionally, as plant matter is packed tightly in each pre-roll paper, the difference in air pressure between the distal and proximal ends of the pre-roll paper results in a vacuum that enhances the apparatus's ability to tightly pack plant matter into each pre-roll paper.

Thus an air current generator capable of producing air current is provided. This air current generator may be a motorized fan, an air pump, or any other means for circulating air through the apparatus. The air current generator may include an air output portion from which air may move out of the air current generator and throughout the apparatus, and an air intake portion capable of receiving the air within the apparatus to perpetuate circulation of air within the apparatus. The air current generator may produce a steady air current throughout the apparatus, it may produce an air current of fluctuating intensity, or it may produce bursts of air current when desirable. The air current generator may also be equipped with an air intake capable of drawing in air from outside of the apparatus to increase air current and/or air pressure within the apparatus.

According to a further aspect, a means for retaining the air current generated by the air current generator within the apparatus is presented. Air flow may be achieved using one or more channels that direct air from the air outlet portion of the air current generator and back to air intake portion of the air current generator. Such air flow may be achieved using a single channel affixed on one end to the air outlet portion of the air current generator, and on an opposite end to the air intake portion of the air current generator so no air from the surrounding atmosphere may enter the apparatus where the channel is affixed to the air current generator. The channels may include passages, such as tubes or pipes made from plastic, metal, glass, or any other airtight material suitable for achieving the stated purpose.

The system may include a device or devices for holding pre-roll papers within the system, and may hold one or more pre-roll papers. Each pre-rolled paper may be held within the apparatus using a tray with one or more holes into which pre-rolled papers can be placed, and clamps may be provided to secure pre-rolled papers in a channel. Adhesives, sleeves or molds may be used to receive pre-rolled papers, and any other suitable holding device wherein air can pass through while maintaining a crutch or pre-rolled paper may be employed. The pre-rolled papers are held or maintained to allow air current produced by the air current generator to pass through each pre-rolled paper as the air cycles through the system. Airflow around each pre-rolled paper may be limited because reducing airflow around each pre-rolled paper results in a stronger vacuum within the system. However, varying vacuum strength may be desirable in certain instances, and the apparatus may enable some air to flow past each pre-rolled paper. Additionally, air valves may be placed throughout out the apparatus to facilitate the release of air or the addition of air, if desired or necessary.

The apparatus may be assembled so that the pre-rolled papers are located within a dedicated holding portion or element. Such a holding portion may be outfitted with an opening to place pre-rolled papers into the apparatus, such as a closable door or window. The holding portion may be detachable from the rest of the system. A detachable holding portion can enable users to insert pre-rolled papers into the holding portion with greater speed and efficiency. Additionally, each holding portion may be fitted to hold a single pre-rolled paper or a plurality of pre-rolled papers.

Plant matter may be introduced into the apparatus through the pre-rolled paper holding portion, such as by placing loose plant matter into the holding portion when pre-rolled paper is inserted into the holding portion, or by loosely placing plant matter into each pre-rolled paper before being placed into the holding portion of the apparatus. Alternatively, the apparatus may be equipped with a device or procedure for introducing loose plant matter into the system. Loose plant matter may be introduced into the apparatus through a filling duct antecedent in the path of air flow to the holding portion so that air current can draw loose plant matter introduced into the apparatus into pre-rolled paper positioned in the holding portion of the apparatus. This filling duct may act as an additional option for introducing air into or releasing air from the apparatus. Alternatively, the filling duct may be equipped with a cover, flap, plug, or other means of preventing air from moving in or out of the apparatus.

Also included is an embodiment directed to a linear, and not circular, system wherein air is similarly provided to the organic leafy material, the pre-rolled paper, and the holder to effectuate the even distribution and packing of the pre-rolled paper with organic leafy material. In this embodiment, the system allows introduction of organic material into the pre-rolled paper and airflow is employed to pack the organic leafy material into the pre-rolled paper(s). A holding device may be employed in this embodiment.

The present design produces filled and packed cigarettes by placing one pre-rolled paper or a plurality of pre-rolled papers into a holding portion of the apparatus, placing ground plant matter into the apparatus, and activating the air current generator to produce air current. The apparatus is designed such that air flows through the pre-rolled papers, and in one embodiment, circulates through the apparatus. Air current produced by the air current generator and circulating in this embodiment causes plant matter to move into the open distal end of the pre-rolled papers, where the distal end is the end of the completed cigarette where a smoker will ultimately ignite the cigarette. As ground plant matter accumulates in the pre-rolled papers, the system creates a difference in air pressure on either side of the pre-rolled papers, resulting in a vacuum within the apparatus. The resulting vacuum further compresses the plant matter inside the pre-roll papers. The air current generator can then be deactivated, and the cigarettes produced by packing plant matter into the pre-rolled papers can then be removed from the apparatus.

FIG. 1 illustrates a representation of one embodiment of the design. The apparatus includes an air current generator 105 with an outlet portion 106 and an intake portion 107. The air current generator 105 is capable of producing air current that flows through the outlet channel 108, through the holding portion 112, through the intake channel 109, and back to the intake portion 107 of the air current generator 105. The holding portion 108 of the apparatus is designed to hold at least one pre-rolled paper in the system using a holding apparatus 113. Ground plant matter may be introduced into the apparatus via the filling duct 110, which may be equipped with a filling cover 111 that prevents air from escaping through the filling duct 110 when the apparatus is turned on.

Holding apparatus 113 is shown in simplified form as two lines but may represent any type of holding apparatus. Variations of the holding apparatus are discussed herein. In essence, the holding apparatus holds and maintains the pre-rolled paper at a beneficial orientation to receive organic leafy material and enable the packing of such material in the system shown. As may be appreciated, various such holding arrangements may be employed.

The air current generator 105 is in one embodiment a motorized fan that draws in air from outside of the apparatus as well as from the intake channel 108 of the apparatus and generates air current that is released through the outlet portion 106 of the air current generator 105 to circulate throughout the apparatus. In alternative embodiments, the air current generator 105 may be include different airflow generation devices, with the general ability to receive air and force air through a tube or other channel. Air pumps and compressors, for example, may be employed.

The holding portion 108 shown is FIG. 1 is designed to hold a single pre-rolled paper or multiple pre-rolled papers within the apparatus. The holding portion of the apparatus may be equipped to hold a plurality of pre-rolled papers so that a number of pre-rolled papers may be filled with plant matter simultaneously using the apparatus.

Figure 2:
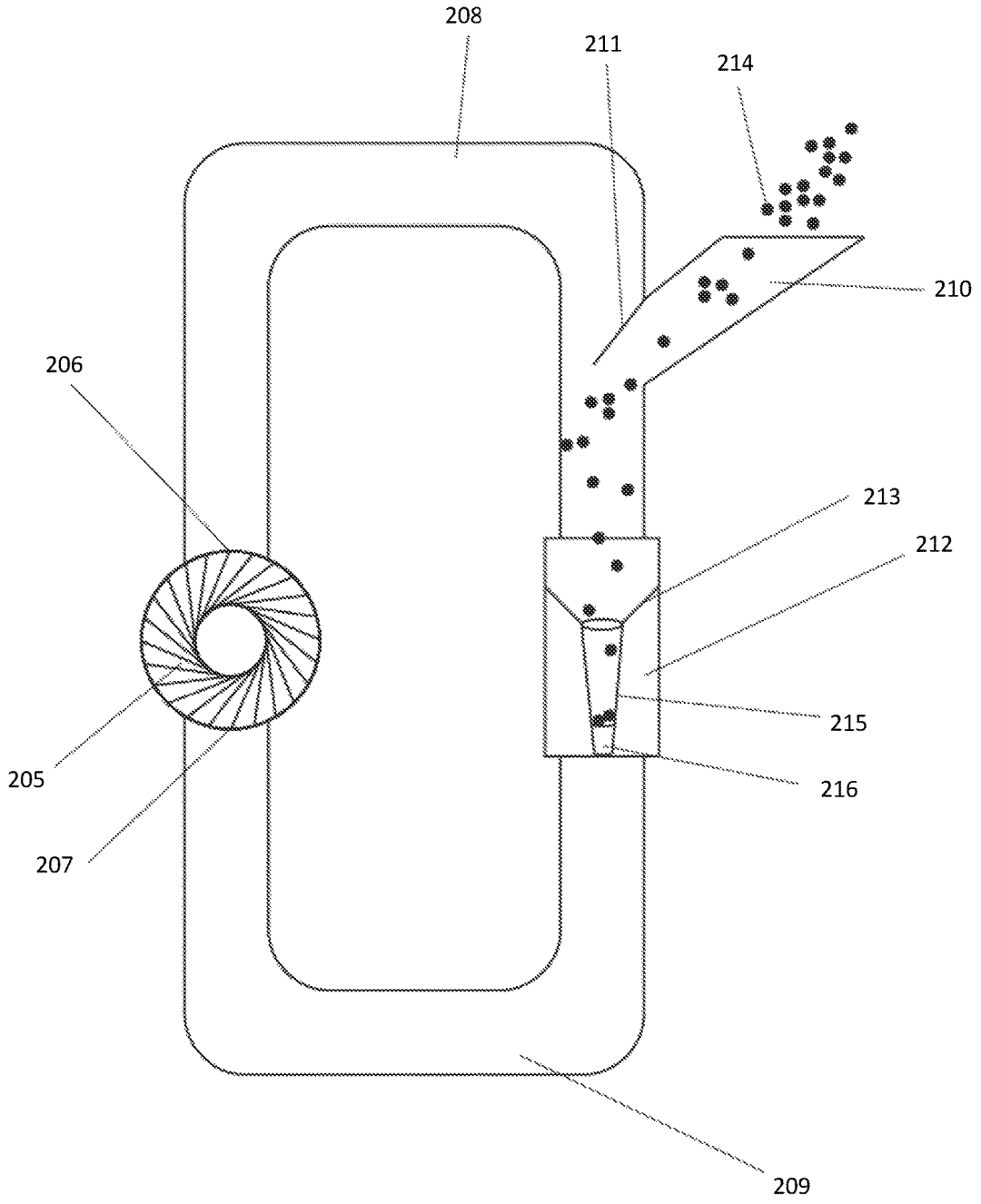
FIG. 2 shows an embodiment wherein a pre-rolled paper has been placed within the apparatus and ground plant matter is being added to the system, but no air current is circulating within the apparatus.

FIG. 2 illustrates a pre-rolled paper 215 held in place by a holding apparatus 213 in the holding portion 212 of the system. Ground plant matter 214, such as *Cannabis*, may be added to the system through the filling duct 210. Such added material falls past the filling cover 211 into pre-roll paper 215. The crutch 216 of the pre-rolled paper 215 ensures the ground plant matter 214 remains in the pre-rolled paper. The air current generator 205 is not producing air current in FIG. 2, but air current originating from the air current generator 205 passes through the system's outlet channel 208 via the air current generator's outlet portion 206, through the ground plant matter 214, pre-rolled paper 215, and crutch 216 before returning to the air current generator's intake portion 207 via the system's intake channel 209. All such flow occurs when the air current generator 205 is activated.

In the embodiment of FIG. 2, the apparatus is equipped with a filling duct 214 for introducing plant matter into the apparatus, and a filling cover 211 preventing air from moving through the filling duct 214 when the apparatus is activated. In alternative embodiments, a plug, valve, or other means of reducing airflow through the filling duct 214 may be used in place of the filling cover 211. The apparatus may also function without a filling duct 214, and plant matter may be introduced into the apparatus through an alternative route or channel, such as using the same device(s) or procedure used to place pre-roll papers into the apparatus.

Figure 3:
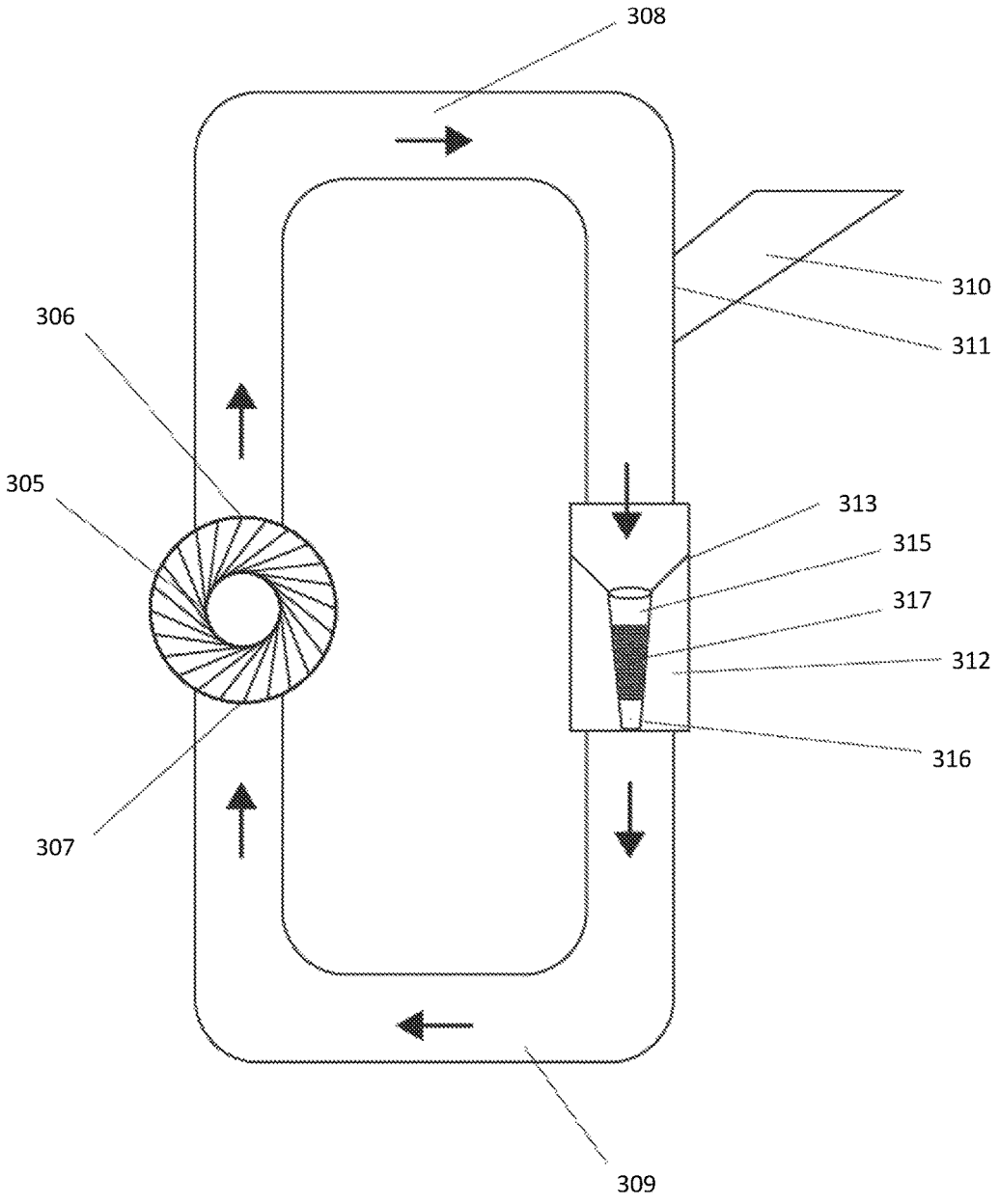
FIG. 3 is an embodiment wherein air is circulating within the apparatus to pack ground plant matter into a pre-roll paper or wrapper.

FIG. 3 illustrates an embodiment wherein air is circulating within the system. Air current originates at the air current generator 305 and moves from the air current generator's outlet portion 306 into the outlet channel 308. As air circulates within the apparatus, the air current closes the filling cover 311 and air becomes unable to escape the apparatus through the filling duct 310. Airflow continues into the holding portion 312 of the system and through pre-roll paper 315 held in place by a holding element 313. The airflow in the pre-roll paper results in condensed plant matter 317 or organic leafy material within the pre-roll paper 315. The condensed plant matter 317 creates limited airflow through the crutch 316 and into the intake channel 309. Such operation produces a vacuum that further enhances the ability to condense plant matter into each pre-rolled paper 315. Air in the intake channel 309 returns to the air current generator 305 via the intake portion 307 of the air current generator. Air current produced by the air current generator 305 may be adjusted to flow consistently, fluctuate in intensity, or take form as bursts of air throughout the apparatus to improve the seating and packing of plant matter in positioned pre-rolled papers.

Figure 4B:
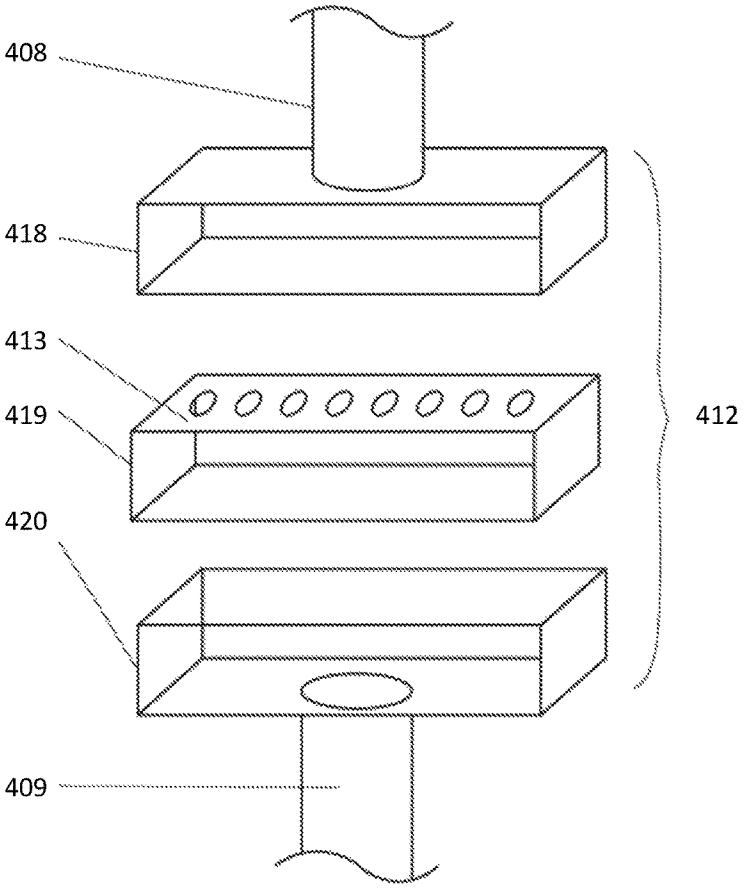
FIG. 4B illustrates an exploded sectioned perspective view of a holding apparatus holding a plurality of pre-roll papers within the overall apparatus.
Figure 4A:
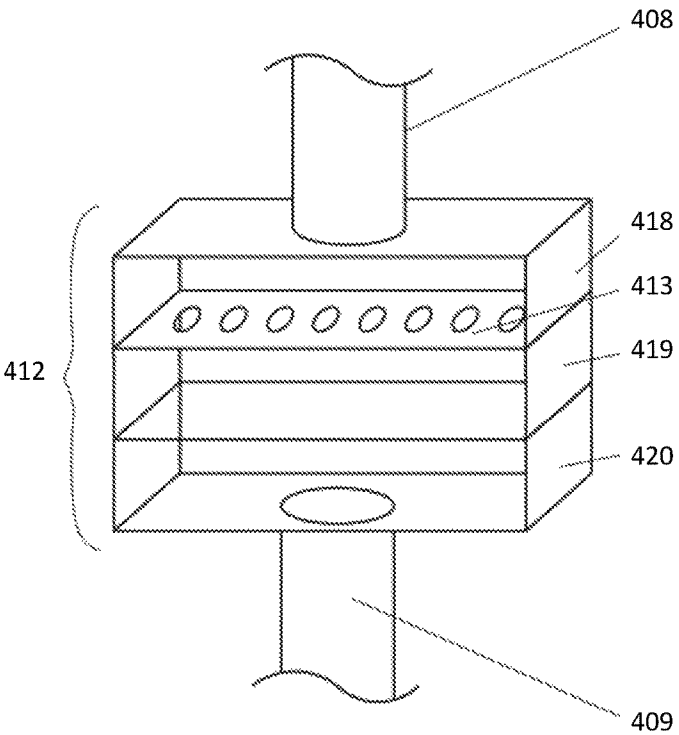
FIG. 4A illustrates a sectioned perspective view of a holding apparatus holding a plurality of pre-roll papers within the overall apparatus.

FIG. 4A illustrates a sectioned perspective view of the preferred means for holding a pre-roll papers within the system. FIG. 4A depicts a holding portion 412 capable of housing a plurality of pre-roll papers. The holding portion 412 consists of an outlet section 418 for receiving air passing through the outlet channel 408, a separate middle section 419 with a holding element 413, and an intake section 420 for directing airflow into the intake channel 409 of the system. The outlet section 418, middle section 419, and intake section 420 of the holding portion 412 fit together so that the middle section 419 is adjacent to the outlet section 419 on one side and the intake section 420 on the opposite side so that air passes through but does not escape the system through the holding portion 412. In this embodiment, the holding element 413 is a tray with a plurality of holes into which pre-rolled papers may be inserted. In alternative embodiments, the holding portion may consist of a single section and devices or procedures for placing pre-rolled papers into the holding section, such as through a window, door, or other closable aperture providing access the interior of the holding section.

FIG. 4B illustrates an exploded sectioned perspective view of the holding portion 412 shown in FIG. 4A. FIG. 4B shows how the outlet section 418, middle section 419, and intake section 420 of the holding portion 412 may be detached. Such a construction facilitates the removal of the middle section 419 so that pre-rolled papers may be placed in the holding element 413 of the middle section 419. In this instance, the holding element 413 is a tray with holes into which pre-rolled papers may be placed. The outlet section 418 remains attached to the outlet channel 408, and the intake section 420 remains connected to the intake channel 409.

While shown as rectangular elements in FIGS. 4A and 4B, it is to be understood that the holding portions and holding elements may take other shapes, such as circular, and intake and outflow elements may also be of different shape or configuration, using conical or frustum shaped inlets, round trays or holding devices, and so forth. The general goal of the device is to locate multiple empty pre-rolled papers in a holder at one time, introduce leafy organic material into the device in a manner that disperses such material into the pre-rolled papers and packs the material in the papers. Minimal unused product is desirable, but unused leafy organic material that is not packed into the pre-rolled papers may be collected and reintroduced as desired.

The holding apparatus, holding portions, and holding elements may receive organic leafy material and may offer outlets such that unused product cycles back through the apparatus, or product that does not fall into the pre-rolled papers may simply collect at the top of the holder or otherwise in the holder. An even distribution of product may or may not be achieved, and thus more product may be added to fill unfilled rolling papers. Additionally, the various embodiments provided herein include holding trays or holding apparatus for the unfilled rolling papers. To provide an even distribution of material, it may be beneficial to provide a mechanism to shake or vibrate the papers contained in such holding devices, causing the product to settle further in using gravity. Such a shaking device may shake the holding apparatus horizontally and may be on a timer, may be controller operated, or may occur on a predetermined basis, such as when all product has been distributed to and passed to the unfilled rolling papers. Various modes and devices used for shaking may be employed, such as placement on a shaking table having openings allowing air and product to pass through, and even manual shaking devices. Such shaking preferably facilitates settlement of product in the unfilled rolling papers.

Filling of the unfilled rolling papers may employ the air current generator or may be done by hand. Further, product may be individually funneled or directed to the various pre-rolled papers being maintained in the flow of air. And other forms may be employed, such as a circular, square, or other shape holder, a conical or funnel shaped holder intake region, multiple funnels for collecting and hopefully evenly distributing product, or otherwise. The present design contemplates effectively and efficiently distributing organic leafy material into each and every pre-rolled paper in the arrangement, with unused product either being further circulated in this embodiment or retrieved after airflow application ceases.

Figure 5B:
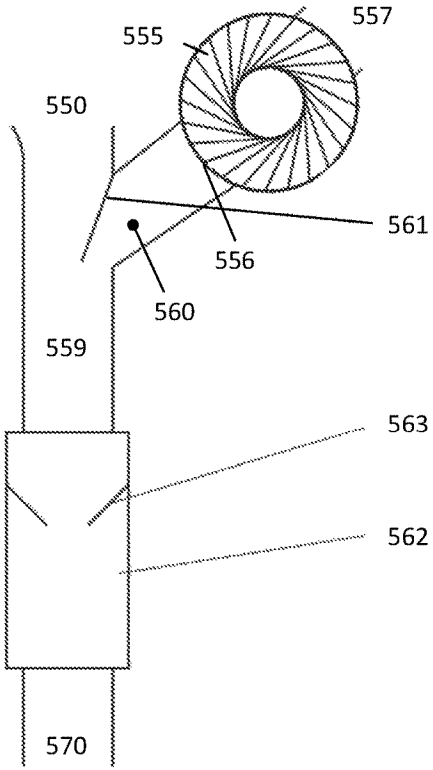
FIG. 5B is a second linear embodiment of the current design.
Figure 5A:
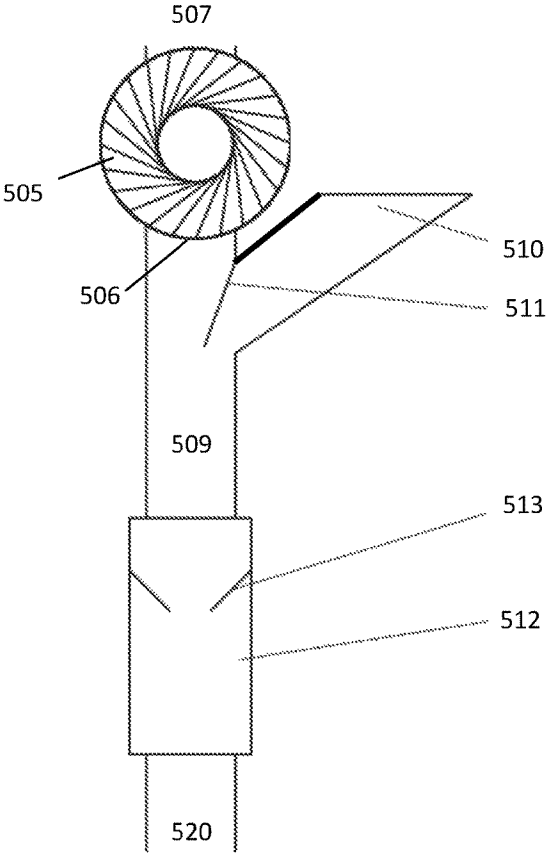
FIG. 5A illustrates a first linear embodiment of the current design.

FIGS. 5A and 5B illustrate alternate versions of the design. The representations of FIGS. 1-4B may be considered a "circular" arrangement, i.e. one where airflow travels in a circle through the various channels and tubing provided with the benefit of an airflow generating device. The depiction of FIG. 5 is a linear arrangement that uses airflow and air pressure to distribute product, such as organic leafy material, into an arrangement of pre-rolled paper or papers. From FIG. 5A, there is provided an air current generator 505 having outlet portion 506 that is provided to channel 509, with a filling duct 510 and filling cover 511 similar to depictions of the circular arrangement presented herein. Also shown is holding apparatus 513 and 512, as well as outlet passage 520 and air current generator inlet 507. In operation, the design of FIG. 5A may be oriented vertically, i.e. air current generator 505 above channel 509, or the arrangement may be provided at an angle or may even be horizontal, i.e. the air current generator 505, channel 509, and holding apparatus may be at a same or similar height. Such a horizontal orientation may limit the amount of pre-rolled papers that can be filled, and may require a relatively high powered air current generator 505. In the vertical orientation, material may be placed in filling duct 510 and may simply drop into the air flow stream by gravity. Filling cover 511 may be optional in this single-channel linear arrangement.

FIG. 5B is a further alternative wherein product, such as leafy organic material, is dropped into opening 550 and air current generator 555 is located outside, or off-axis of, channel 559. Duct 560 is shown and, as with all drawings in the present application, duct 560 is not to scale and may be provided even further from channel 559 as long as sufficient air current flows through channel 559. In this embodiment, holding apparatus 563 and holding portion 562 is shown as well as outlet passage 570. Air current generator may be turned on, providing air to channel 509, holding apparatus 563 and outlet passage 570, and organic leafy material provided through opening 550.

An air inlet, such as inlet 507 or inlet 557, is provided with air current chamber 505 and air current chamber 555 to intake air. Air current generators 505 and 555 may again be a motorized air pump, motorized fan, or other air blowing device. Air taken into inlet 507 or inlet 557 blows through the respective channel, the holding arrangement and each pre-rolled paper provided and out though outlet passages 520 and 570.

Thus according to one embodiment, there is provided an apparatus comprising an air current generator with an air outlet portion and an air intake portion, a channel configured to channel air current from the air outlet portion of the air current generator, means for holding at least one pre-rolled paper in the channel so that air current generated by the air current generator passes through all pre-rolled papers, and an opening configured to receive organic leafy material and introduce the organic leafy material received into the channel. Airflow from the air current generator provides organic leafy material to the opening, the channel, and the at least one pre-rolled paper in the channel.

According to a further embodiment, there is provided a method filling pre-roll papers comprising placing at least one pre-rolled paper in an airflow apparatus and inserting organic leafy material into the airflow apparatus while airflow is generated within the apparatus. Inserting organic leafy material into the airflow apparatus causes the organic leafy material to pack into the at least one pre-rolled paper.

According to another embodiment, there is provided an apparatus, comprising an air current generator, a channel configured to channel air current from the air current generator, at least one pre-rolled paper positioned in the channel so that air current generated by the air current generator passes through each pre-rolled paper, and an opening configured to receive organic leafy material and introduce the organic leafy material received into the channel. Airflow from the air current generator provides organic leafy material to the opening, the channel, and the at least one pre-rolled paper in the channel.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An apparatus comprising:
an air current generator with an air outlet portion and an air intake portion;
a channel configured to channel air current from the air outlet portion of the air current generator;
a pre-rolled paper holder apparatus configured to hold at least one pre-rolled paper in the channel so that air current generated by the air current generator passes through all pre-rolled papers; and
an opening configured to receive organic leafy material and introduce the organic leafy material received into the channel;
wherein airflow from the air current generator provides organic leafy material to the opening, the channel, and the at least one pre-rolled paper in the channel, and wherein the air current generator draws in air from outside of the apparatus to generate air current within the apparatus when activated.

2. The apparatus of claim 1, wherein the air current generator is a motorized fan.

3. The apparatus of claim 1, wherein the air current generator is a motorized pump.

4. The apparatus of claim 1, wherein the channel is configured to channel air current from the air outlet portion of the air current generator and back to the air intake portion of the air current generator.

5. The apparatus of claim 1, wherein the air current generator generates air current through the channel when activated.

6. The apparatus of claim 1, wherein a plurality of pre-rolled papers is held in the channel.

7. The apparatus of claim 1, wherein the pre-rolled paper holder apparatus comprises a detachable holding portion configured to receive the at least one pre-rolled paper.

8. The apparatus of claim 1, further comprising a valve configured to release air from within the apparatus.

9. The apparatus of claim 1, wherein the opening comprises a filling duct.

10. A method filling pre-roll papers comprising:
placing at least one pre-rolled paper in an airflow apparatus; and
inserting organic leafy material into the airflow apparatus while airflow is generated within the apparatus;
wherein inserting organic leafy material into the airflow apparatus causes the organic leafy material to pack into the at least one pre-rolled paper and wherein the air flow apparatus draws in air from outside of the airflow apparatus to generate airflow within the airflow apparatus when activated.

11. The method of claim 10, wherein the at least one pre-rolled paper is placed in a holding apparatus configured to maintain a plurality of pre-rolled papers.

12. The method of claim 11, wherein the airflow apparatus comprises a circular flow arrangement wherein air is received at an airflow generator, passed to a channel and the holding apparatus.

13. The method of claim 12, wherein airflow circulates back to the airflow apparatus.

14. An apparatus comprising:
an air current generator;
a channel configured to channel air current from the air current generator;

at least one pre-rolled paper positioned in the channel so that air current generated by the air current generator passes through each pre-rolled paper; and an opening configured to receive organic leafy material and introduce the organic leafy material received into the channel;

wherein airflow from the air current generator provides organic leafy material to the opening, the channel, and the at least one pre-rolled paper in the channel, and wherein the air current generator draws in air from outside of the apparatus to generate air current within the apparatus when activated.

15. The apparatus of claim 14, wherein the channel is configured to channel air current from an air outlet portion of the air current generator and back to an air intake portion of the air current generator.

16. The apparatus of claim 14, further comprising a holding device configured to hold a plurality of pre-rolled papers in the channel.

17. The apparatus of claim 14, further comprising a detachable holder configured to receive the at least one pre-rolled paper.

18. The apparatus of claim 14, further comprising a valve configured to release air from within the apparatus.

* * * * *